US010031454B2

(12) United States Patent
Mukoyama et al.

(10) Patent No.: US 10,031,454 B2
(45) Date of Patent: Jul. 24, 2018

(54) FIXING BELT, FIXING DEVICE, IMAGE FORMING APPARATUS AND IMAGE FORMATION METHOD

(71) Applicant: Konica Minolta, Inc., Tokyo (JP)

(72) Inventors: Izumi Mukoyama, Tokyo (JP); Hirofumi Koga, Tokyo (JP); Go Yamaguchi, Tokyo (JP); Asao Matsushima, Tokyo (JP); Akira Ohira, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/010,501

(22) Filed: Jan. 29, 2016

(65) Prior Publication Data

US 2016/0223967 A1 Aug. 4, 2016

(30) Foreign Application Priority Data

Feb. 2, 2015 (JP) ..... 2015-018342

(51) Int. Cl.
*G03G 15/20* (2006.01)

(52) U.S. Cl.
CPC . *G03G 15/2057* (2013.01); *G03G 2215/2032* (2013.01)

(58) Field of Classification Search
CPC ..... G03G 15/2057; G03G 15/2053; G03G 2215/2032; G03G 2215/2048
USPC ..... 399/329, 333
See application file for complete search history.

(56) References Cited

U.S. PATENT DOCUMENTS 7,359,665 B2 * 4/2008 Onodera ..... G03G 15/2053 399/329
8,571,458 B2 * 10/2013 Okada ..... G03G 15/2053 399/329
2005/0031386 A1 * 2/2005 Fujiwara ..... G03G 15/2064 399/328

(Continued)

FOREIGN PATENT DOCUMENTS

JP H10-104973 A 4/1998
JP H11-174885 A 7/1999

(Continued)

OTHER PUBLICATIONS

Notice of Reasons for Rejection dated Jan. 31, 2017 from the corresponding Japanese Patent Application No. JP 2015-018342; English translation of Notice of Reasons for Rejection; Total of 8 pages.

(Continued)

*Primary Examiner* — Hoang Ngo
(74) *Attorney, Agent, or Firm* — Lucas & Mercanti, LLP

(57) ABSTRACT

A fixing belt according to the present invention has an endless shape and includes a base layer made of a heat-resistant resin; an elastic layer made of an elastic material; and a releasing layer which are stacked on one another in this order in which: the loss tangent tan δ of the elastic material at 20 Hz is 0.1 or smaller; and the fixing belt is mounted in a fixing device in the state where the belt is rotatably supported by two or more rollers including a heating roller, whereby favorable fixation performance and favorable separativeness relative to a recording medium can be achieved even in high speed image formation of an electrophotographic process.

14 Claims, 4 Drawing Sheets

(56) References Cited

U.S. PATENT DOCUMENTS

| | | | | |
|---|---|---|---|---|
| 2005/0163543 | A1* | 7/2005 | Satoh | G03G 15/2064 399/329 |
| 2006/0269307 | A1* | 11/2006 | Funabiki | G03G 15/2064 399/45 |
| 2013/0302074 | A1* | 11/2013 | Lee | G03G 15/2057 399/333 |
| 2014/0301762 | A1* | 10/2014 | Inoue | G03G 15/2057 399/333 |

FOREIGN PATENT DOCUMENTS

| | | | |
|---|---|---|---|
| JP | H11-224006 | A | 8/1999 |
| JP | 2005300591 | A | 10/2005 |
| JP | 2006-235573 | A | 9/2006 |
| JP | 2008158053 | A | 7/2008 |
| JP | 2012-042853 | A | 3/2012 |

OTHER PUBLICATIONS

Decision of Rejection dated Jun. 13, 2017 from the corresponding Japanese Patent Application No. JP 2015-018342 and English translationpages.

Notice of Reasons for Rejection dated Apr. 17, 2018 from the corresponding Japanese Patent Application No. JP 2015-18342. Appeal No. JP 2017-13582, and English translation Non-Patent Literature by Shinichi Sumimura, et al., "Structures and properties of silicone rubber," Kobunshi, The Society of Polymer Science, Japan, Jun. 1988, vol. 37, No. 6, p. 448-451 and English translation of page 450, right column, lines 1-12 and Fig. 5 ofthe document.

* cited by examiner

FIXING BELT, FIXING DEVICE, IMAGE FORMING APPARATUS AND IMAGE FORMATION METHOD

This application is entitled to and claims the benefit of Japanese Patent Application No. 2015-018342, filed on Feb. 2, 2015, the disclosure of which including the specification, drawings and abstract is incorporated herein by reference in its entirety.

BACKGROUND OF THE INVENTION

Field of the Invention

The present invention relates to a fixing belt, a fixing device, an image forming apparatus and an image formation method.

Description of Related Art

Normally, in fixing devices employed in image forming apparatuses such as copiers and laser beam printers, a heated fixing belt is brought into contact with a recording medium bearing an unfixed toner image to fix the toner image to the recording medium. In such fixing devices, for example, one of two or more rollers that rotatably support the fixing belt is a heating roller that applies heat to the fixing belt. Since the thermal capacity of the fixing belt is relatively small, the fixing devices provide favorable fixation performance, and are advantageous in terms of speedup of image formation, for example.

Known examples of the fixing belt include: an endless fixing belt including a viscoelastic layer, a base layer and a releasing layer which are stacked on one another in this order, and having a loss modulus of 20 to 80 GPa; and an endless fixing belt including a base layer, an elastic layer and a surface layer which are stacked on one another in this order in which a loss tangent tan δ which is a ratio of a loss modulus relative to a storage modulus at 180° C., amplitude 10 μm, and 1 Hz in the elastic layer is 0.06 to 0.2 (see, for example, Japanese Patent Application Laid-Open No. 2008-158053 and Japanese Patent Application Laid-Open No. 2005-300591).

Meanwhile, further speedup in the image formation of the image forming apparatus is demanded. In general, when the fixing rate (also referred to as "printing rate") in an image forming apparatus is low, the tensile force of the fixing belt in the fixing device increases. The reason for this is that in a low speed image forming apparatus, rollers having a small roller diameter are used as rollers of the fixing device, and consequently, it is required to increase the tensile force to interlock the fixing belt with the rotation driving of the rollers that rotatably support the fixing belt while preventing the slip between the fixing belt and the rollers.

Normally, when the printing rate of the image forming apparatus increases, the roller diameter of the roller increases for the heat value that should be held by the roller, and consequently the tensile force of the fixing belt decreases. This reduces the ease of separation of the recording medium on which a toner image has been fixed from the fixing belt. As a result, paper jam (also referred to as "jam") is easily caused. As such, a so-called biaxial belt fixing device in which the fixing belt that is heated by a heater is rotatably supported has a room for improvement in terms of speedup.

SUMMARY OF THE INVENTION

An object of the present invention is to provide a fixing belt which provides favorable fixation performance of the toner image as well as favorable separativeness of the recording medium.

Another object of the present invention is to achieve fixation in which both the fixation performance of the toner image and the separativeness of the recording medium are favorable.

In general, the fixation performance of a toner image to a recording medium and separativeness of the recording medium from the fixing nip portion in a fixing device is handled by designing of the toner. The present inventors tackled the problems of the fixation performance and the separativeness from the perspective of the design of the fixing belt, and completed the present invention as a result of extensive studies.

To achieve the above-mentioned objects, a fixing belt according to an embodiment of the present invention includes: a base layer including a heat-resistant resin; an elastic layer including an elastic material; and a releasing layer, the base layer, the elastic layer and the releasing layer being sequentially stacked on one another, the fixing belt having an endless form and being to be rotatably supported by two or more rollers including a heating roller, in which the elastic material has a loss tangent tan δ of 0.1 or smaller, the loss tangent tan δ being a ratio of a loss modulus relative to a storage modulus at 20 Hz.

To achieve the above-mentioned objects, a fixing device according to the embodiment of the present invention includes: the fixing belt having an endless form; two or more rollers rotatably supporting the fixing belt, the two or more rollers including a heating roller for applying heat to the fixing belt; and a pressure roller disposed to be relatively biased against one of the rollers with the fixing belt therebetween.

To achieve the above-mentioned objects, an image forming apparatus according to the embodiment of the present invention includes the fixing device configured to heat and press an unfixed toner image formed by an electrophotographic process on a recording medium to fix the unfixed toner image to the recording medium.

To achieve the above-mentioned objects, an image formation method according to the embodiment of the present invention includes fixing an unfixed toner image formed by an electrophotographic process on a recording medium to the recording medium by heating and pressing the unfixed toner image with use of the fixing device.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1A:
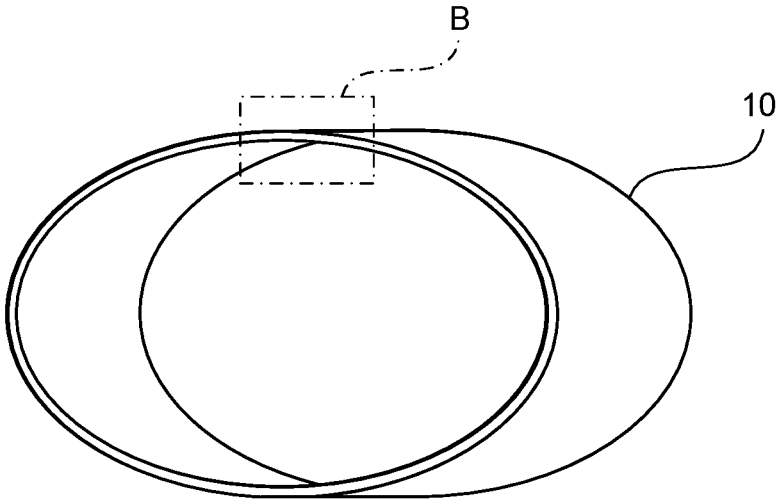
FIG. 1A schematically illustrates an example of a fixing belt according to an embodiment of the present invention.

In the following, an embodiment of the present invention is described.

[Fixing Belt]

A fixing belt according to the present embodiment includes a base layer made of a heat-resistant resin, an elastic layer made of an elastic material, and a releasing layer which are stacked on one another in the mentioned order. The fixing belt is formed in an endless shape, and is rotatably supported by two or more rollers including a heating roller, with the releasing layer disposed outside.

In the elastic material, loss tangent tan δ which is the ratio of the loss modulus relative to the storage modulus at 20 Hz is 0.1 or smaller. One reason for this may be as follows.

In a biaxial belt fixing device for heating, rotatably supporting, and rotating the fixing belt, the fixing belt and a pressure roller facing the fixing belt form a fixing nip for sandwiching a recording medium. The fixation performance at the fixing nip portion is depends on the flexibility of the fixing belt. Therefore, from the view point of fixation performance, the fixing belt is preferably soft.

Meanwhile, as described above, when the printing rate is increased, the tensile force of the fixing belt is required to be reduced. In this case, the behavior of the fixing belt being rotated at high speed is easily influenced by the physical property of the fixing belt. Accordingly, it can be said that the ease of separation of the recording medium from the fixing belt after the fixation also depends on the physical property of the fixing belt to some extent.

To be more specific, in the biaxial belt fixing device, the separativeness between the fixing belt and the recording medium at a position on the outlet side (the downstream side in the conveyance direction of the recording medium) of the fixing nip portion may depend on the resilience of the fixing belt. Accordingly, it can be said that, in a high-speed image formation method using an electrophotographic process, favorable separation of the recording medium from the fixing belt immediately after the fixation requires generation of adequate resilience of the fixing belt at the fixing nip portion. Further, it can be said that the generation of such resilience largely depends on the viscoelasticity of the elastic layer.

When loss tangent tan δ obtained by a dynamic viscoelasticity measurement at 20 Hz is 0.1 or smaller in the elastic material, the fixation performance and the separativeness at the fixing nip portion are both satisfied. When the tan δ is excessively high (for example, when the viscosity of the elastic material is excessively high relative to its elasticity), the separativeness is insufficient. One possible reason for this may be that the resilience relating to the separativeness of the elastic material is insufficient as described above.

Therefore, the tan δ is preferably 0.1 or smaller from the viewpoint of achieving both the fixation performance and the separativeness, and is preferably 0.05 or smaller from the viewpoint of enhancing the separativeness. In addition, the tan δ is preferably greater than 0.01 from the viewpoint of obtaining the favorable dynamic viscoelasticity.

The tan δ can be measured using a publicly known dynamic viscoelasticity measuring device using a test specimen of the elastic material. In addition, the tan δ can be changed by adjusting the type or the composition of the elastic material, the content of the additive such as filler, and the like.

The base layer is made of a heat-resistant resin. The heat-resistant resin is appropriately selected from resins that are not modified or deformed at temperatures at which the fixing belt is used. Examples of the heat-resistant resin include polyphenylene sulfide, polyarylate, polysulfone, polyether sulfone, polyetherimide, polyimide, polyamideimide and polyetheretherketone, which may be used alone or in combination. Among them, polyimide is preferable from the view point of heat-resistance.

Polyimide can be obtained through progression of dehydration/cyclisation (imidization) reaction of polyamic acid, which is the precursor of polyimide, by heating at 200° C. or above, or by using a catalyst. Polyamic acid may be a commercially available product, or may be manufactured by dissolving tetracarboxylic dianhydride and a diamine compound in solvent and then causing polycondensation reaction by mixing/heating. Examples of the diamine compound and the tetracarboxylic dianhydride include compounds mentioned in Japanese Patent Application Laid-Open No. 2013-25120 (paragraphs 0123 to 0130).

As long as the effect of the present embodiment is obtained, the base layer may contain components other than heat-resistant resins. For example, the material of the base layer may contain other resin components. Preferably, the content of the heat-resistant resin in the material of the base layer is 40 to 100 vol % from the standpoint of workability and the like.

The elastic layer satisfies the tan δ. Examples of the material (elastic material) of the elastic layer include elastic resin materials such as silicone rubbers, thermoplastic elastomer, and rubber materials. Preferably, the elastic material is silicone rubbers from the viewpoint of satisfying the tan δ.

The silicone rubbers may be used alone or in combination. Examples of the silicone rubbers include polyorganosiloxane or the thermally hardened products of polyorganosiloxane, and the addition reaction type silicone rubber mentioned in Japanese Patent Application Laid-Open No. 2009-122317. Examples of the polyorganosiloxane include dimethyl polysiloxane whose both ends are blocked with a trimethylsiloxane group and has a vinyl group on a side chain, which is mentioned in Japanese Patent Application Laid-Open No. 2008-255283.

From the viewpoint of sufficiently obtaining thermal conductivity and elasticity, the thickness of the elastic layer is, for example, preferably 5 to 300 μm, more preferably 50 to 250 μm, still more preferably 100 to 200 μm.

The elastic layer may further contain components other than the elastic resin materials as long as the effect of the present embodiment can be obtained. For example, the elastic material may further contain a thermal conductive filler for enhancing the thermal conductivity of the elastic layer. Examples of the material of the filler include silica, metal silica, alumina, zinc, aluminum nitride, boron nitride, silicon nitride, silicon carbide, carbon and graphite. The form of the filler is not limited, and may be spherical powder, unshaped powder, flat powder or fiber, for example.

Preferably, regarding the content of the elastic resin material in the elastic material, the content of the filler is set to a small value as much as possible from the viewpoint of satisfying the tan δ. The content of the filler is preferably 60 to 100 vol %, more preferably 75 to 100 vol %, still more preferably 80 to 100 vol %, for example.

The releasing layer has a suitable releasability to the toner component. The releasing layer serves as the exterior surface of the fixing belt that makes contact with a recording medium at the time of fixation. Examples of the material of the releasing layer include polyethylene, polypropylene, polystyrene, polyisobutylene, polyester, polyurethane, polyamide, polyimide, polyamideimide, alcohol-soluble nylon, polycarbonate, polyarylate, phenol, polyoxymethylene, polyetheretherketone, polyphosphazene, polysulfone, polyether sulfide, polyphenylene oxide, polyphenylene ether, polyparabanic acid, polyallylphenol, fluororesin, polyurea, ionomer, silicone, and, their mixtures or copolymers. From the standpoint of the releasability and the heat resisting property, the material of the releasing layer is preferably fluororesin, more preferably perfluoro-alkoxy fluororesin (PFA).

From the standpoint of obtaining heat transmission, followability to deformation of the elastic layer and releasability, the thickness of the releasing layer is preferably 5 to 40 μm, more preferably 10 to 35 μm, still more preferably 20 to 30 μm, for example.

As long as the effect of the present embodiment can be obtained, the releasing layer may further contain components other than the resin matrix material. For example, the releasing layer may further contain lubricant particles. Examples of the lubricant particles include fluororesin particles, silicone resin particles and silica particles.

The content of the resin matrix material in the releasing layer material is preferably 70 to 100 vol % from the standpoint of the thermal conductivity and flexibility for sufficiently following deformation of the elastic layer.

As long as the effect of the present embodiment can be obtained, the fixing belt may further contain layers other than the base layer, the elastic layer and the releasing layer. Examples of such a layer include a reinforcement layer.

The reinforcement layer is a layer for increasing the mechanical strength of the fixing belt, and is disposed on the surface (the inner peripheral surface of the base layer) on the side opposite to the elastic layer and the releasing layer in the fixing belt. The reinforcement layer may be composed of the heat-resistant resin, and may have any thickness.

The fixing belt can be produced by publicly known methods for producing a laminated fixing belt. For example, the fixing belt may be produced by a method including a step of covering the exterior surface of an endless molded article made of the heat-resistant resin that serves as the base layer, with a tube that serves as the releasing layer; a step of injecting an elastic material or a precursor thereof between the molded article and the tube; and a step of heating and curing the elastic material or the precursor thereof as necessary.

Figure 1B:
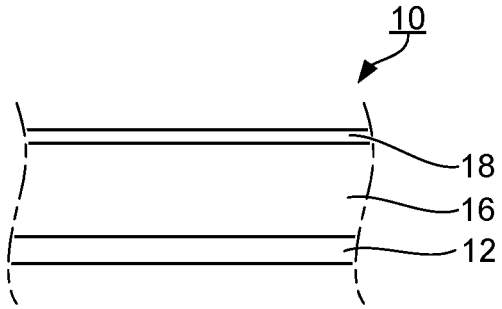
FIG. 1B illustrates part B of FIG. 1A in an enlarged manner.

FIG. 1 illustrates an example of the fixing belt. FIG. 1A schematically illustrates an example of the fixing belt according to an embodiment of the present invention, and FIG. 1B illustrates part B illustrated in FIG. 1A in an enlarged manner.

Fixing belt 10 has an endless shape as illustrated in FIG. 1A, and includes base layer 12, elastic layer 16 disposed on the outer peripheral surface of base layer 12, and releasing layer 18 disposed on the outer peripheral surface of elastic layer 16 as illustrated in FIG. 1B. Base layer 12 is made of polyimide, elastic layer 16 is made of a silicone rubber, and releasing layer 18 is made of PFA, for example.

Elastic layer 16 is composed of a silicone rubber which is obtained by mixing two or more dimethyl polysiloxanes having a trimethylsiloxane group on both ends and having a vinyl group on a side chain, and by crosslinking (curing) the vinyl groups by heating, for example. The tan δ of the silicone rubber is 0.1 or smaller.

The above-mentioned fixing belt 10 is suitable for the fixing belt in the biaxial belt fixing device described below, and brings about remarkable effects in a high-speed image forming apparatus in particular.

[Fixing Device]

The fixing device according to the present embodiment includes the endless fixing belt, two or more rollers that rotatably support the fixing belt, and a pressure roller that is disposed such that it is relatively biased to one of the rollers with the fixing belt therebetween. Except that the fixing belt is provided, the fixing device has a configuration similar to that of a known so-called biaxial belt fixing device.

A plurality of the rollers, which rotatably support the fixing belt, are provided, and the rollers include a heating roller for heating the fixing belt. The heating roller includes a thermal conductive sleeve made of aluminum or the like, and a heating source such as a halogen heater disposed inside the sleeve for example. The outer peripheral surface of the sleeve may be covered with a layer made of a fluororesin such as polytetrafluoroethylene (PTFE).

It suffices that at least one roller is provided in addition to the heating roller that rotatably supports the fixing belt, which may have any configuration in accordance with desired functions.

The tensile force of the fixing belt rotatably supported by the two or more rollers is preferably 46 N or smaller, more preferably 43 N or smaller from the viewpoint of increasing the speed of applicable image formation. The tensile force can be changed by adjusting the elastic force (biasing force) of the elastic member such as a spring that biases the rollers in the direction in which the distance between the axes of the rollers is increased, the distance between the axes of the rollers that rotatably support the fixing belt, and the like, for example.

The pressure roller forms a contacting portion (fixing nip portion) with the fixing belt at the time of fixation. Examples of the pressure roller include a roller having an elastic outer peripheral surface, and a roller whose rotational axis can be brought closer to or separated from the fixing belt.

In the rollers, the roller diameter of the roller biased by the pressure roller is preferably 45 mm or greater, more preferably 60 mm or greater from the viewpoint of increasing the speed of applicable image formation. The upper limit of the roller diameter of the roller may be appropriately set in accordance with the allowable size of the fixing device for example.

In addition, in the fixing device, the separation angle of a recording medium subjected to fixation is preferably 67 to 85 degrees from the viewpoint of increasing the speed of applicable image formation. The separation angle is an angle (θ in FIG. 2) of the tangent to the fixing belt (L2 in FIG. 2) at the downstream end in the conveyance direction of the recording medium at the fixing nip portion, with respect to the straight line (L1 in FIG. 2) parallel to the straight line connecting the axes of the two rollers of the fixing nip portion.

In general, large separation angles are advantageous from the standpoint of speedup of image formation, but are disadvantageous from the standpoint of the separativeness of a recording medium with respect to the fixing belt. However, the fixing belt satisfies the condition of the tan δ. Accordingly, the separativeness can be sufficiently obtained also at relatively large separation angles which have been disadvantageous in speedup of image formation. From the viewpoint of achieving speedup of image formation and the separativeness, the separation angle is preferably 70 to 81 degrees, more preferably 73 to 77 degrees.

The separation angle can be changed by adjusting the roller diameter of the roller that forms the fixing nip portion, the image formation speed, the biasing force (nip pressure) of the pressure roller and the like for example.

As long as the effect of the present embodiment can be obtained, the fixing device may have a components other than the above-mentioned components. Example of such components include a first temperature sensor for detecting the temperature of the fixing belt heated by the heating roller, an axis movement mechanism of the pressure roller, a second heater disposed in the pressure roller, a second temperature sensor for detecting the temperature of the pressure roller, an airflow separation device for generating airflow at the fixing nip portion in the direction of separation of the recording medium from the fixing belt, and a guide member for guiding the recording medium to or from the fixing nip portion. As these components, publicly known members which are used in the publicly known fixing devices may be employed.

In the following, an example the fixing device is described in detail.

Figure 2:
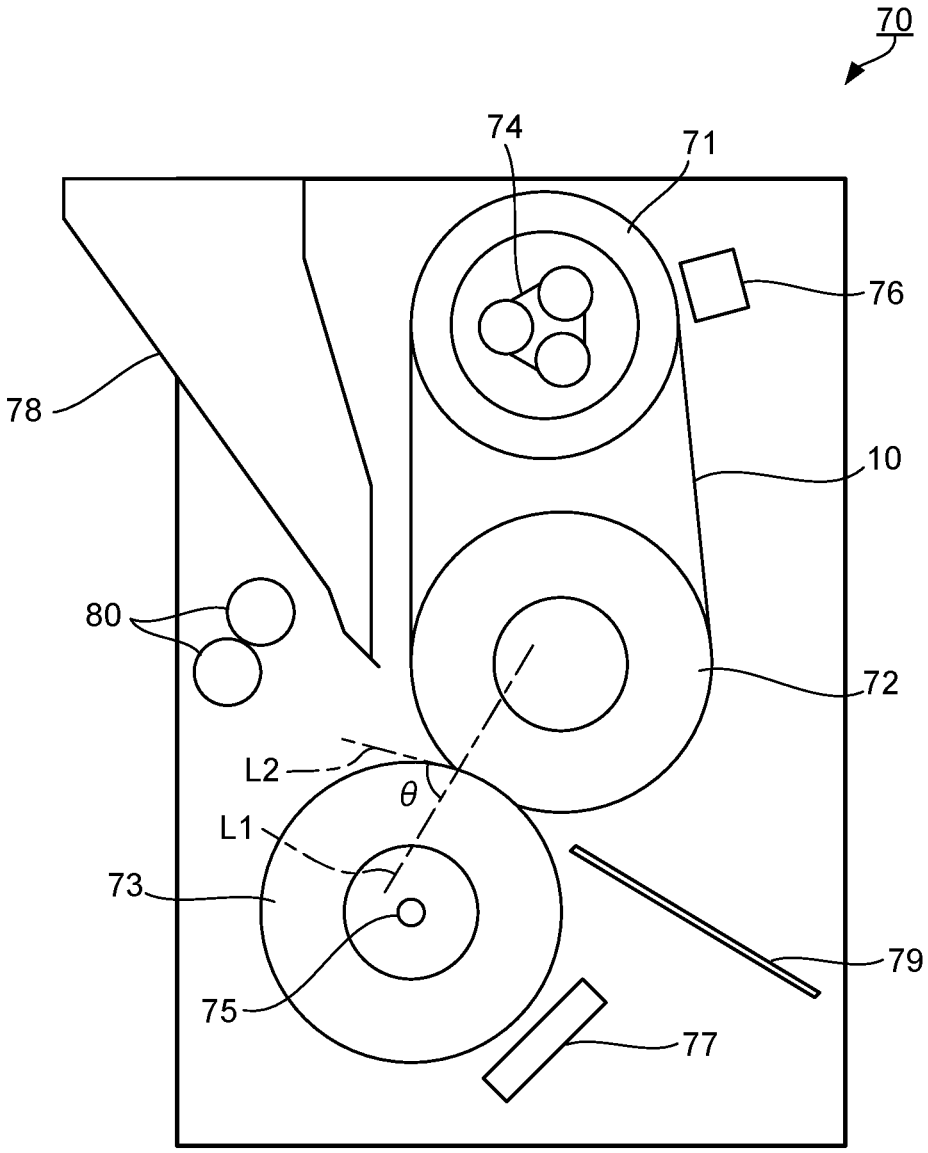
FIG. 2 schematically illustrates an example of the fixing device according to the embodiment of the present invention.

As illustrated in FIG. 2, fixing device 70 includes fixing belt 10, heating roller 71, first pressure roller 72, second pressure roller 73, heaters 74 and 75, first temperature sensor 76, second temperature sensor 77, airflow separation device 78, guide plate 79 and guide roller 80, for example.

Fixing belt 10 is the above-mentioned fixing belt according to the present embodiment. Fixing belt 10 is stretched and rotatably supported by heating roller 71 and first pressure roller 72. The tensile force of fixing belt 10 is 43 N for example.

Heating roller 71 includes a rotatable sleeve made of aluminum, and heater 74 disposed inside the rotatable sleeve. First pressure roller 72 includes a rotatable mandrel, and an elastic layer disposed on the outer peripheral surface of the mandrel, for example.

Second pressure roller 73 is disposed to be opposed to first pressure roller 72 with fixing belt 10 therebetween. Second pressure roller 73 includes a rotatable sleeve made of aluminum, and heater 75 disposed in the sleeve, for example. Second pressure roller 73 is disposed in such a manner that second pressure roller 73 can be brought closer to and separated from first pressure roller 72. When being brought closer to first pressure roller 72, second pressure roller 73 presses the elastic layer of first pressure roller 71 with fixing belt 10 therebetween, and thus forms a fixing nip portion that is a contacting portion with fixing belt 10.

First temperature sensor 76 is a device for detecting the temperature of fixing belt 10 heated by heating roller 71, and second temperature sensor 77 is a device for detecting the temperature of the outer peripheral surface of second pressure roller 73.

Airflow separation device 78 is a device for generating airflow from the upstream side of the movement direction of fixing belt 10 toward the fixing nip portion so as to facilitate separation of the recording medium from fixing belt 10.

Guide plate 79 is a member for guiding the recording medium having an unfixed toner image to the fixing nip portion, and guide roller 80 is a member for guiding the recording medium on which a toner image has been fixed to the outside of the image forming apparatus from the fixing nip portion.

In fixing device 70, the roller diameter of first pressure roller 72 is 60 mm, the rotational movement speed of fixing belt 10 is 315 m/second, and separation angle θ is 73 degrees for example. When the rotational movement speed of fixing belt 10 is converted to the image formation speed ("fixation speed" or "printing rate") to a recording medium of A4 size, the speed is 60 sheets per minute.

In FIG. 2, separation angle θ is an angle, on second pressure roller 73 side, of the tangent to fixing belt 10 at the downstream end in the conveyance direction of the recording medium at the fixing nip portion with respect to straight line L1 parallel to the straight line connecting the rotational axis of first pressure roller 72 and the rotational axis of second pressure roller 73. The separation angle can be changed by adjusting the roller diameter of second pressure roller 73 and the like.

For example, when the separation angle is $\theta_{50}$ (for example, 79 degrees) in the case where second pressure roller 73 has a roller diameter of 50 mm, $\theta_{40}$, which is the separation angle in the case where second pressure roller 73 has a roller diameter of 40 mm, is ($\theta_{50}$−4) degrees. In addition, for example, $\theta_{60}$, which is the separation angle when the roller diameter of second pressure roller 73 is 60 mm, is ($\theta_{50}$+4) degrees.

Fixing belt 10 is rotated at the above-mentioned speed, and is heated by heater 74 to a desired temperature (for example, 190° C.) under the feedback control of first temperature sensor 76, for example. Second pressure roller 73 is heated by heater 75 to a desired temperature (for example, 180° C.) under the feedback control of second temperature sensor 77, for example. In synchronization with the arrival of the recording medium, second pressure roller 73 biases the outer peripheral surface of first pressure roller 72 with fixing belt 10 therebetween so as to form the fixing nip portion.

The recording medium bearing an unfixed toner image is guided by guide plate 79 to the nip portion. Since fixing belt 10 satisfies the condition of the tan δ, fixing belt 10 sufficiently makes close contact with the recording medium. Accordingly, by sufficiently heated fixing belt 10, the unfixed toner image is immediately fixed to the recording medium.

At the downstream end of the fixing nip portion, the force adhering to fixing belt 10 and the force advancing to the tangential direction of fixing belt 10 are exerted on the recording medium on which a toner image has been fixed. As described above, fixing belt 10 that satisfies the condition of the tan δ is considered to exhibit an adequate resilience with respect to the recording medium at the downstream end of the fixing nip portion, and as a result, the recording medium is separated from fixing belt 10 and advanced in the tangential direction of fixing belt 10.

In addition, the recording medium receives airflow from airflow separation device 78 at the downstream end of the fixing nip portion. This facilitates the separation of the recording medium from fixing belt 10.

The recording medium separated from fixing belt 10 is guided by guide roller 80 to the outside of the image forming apparatus.

It is to be noted that, as described above, the fixing nip portion may be formed by depression of the peripheral surface of first pressure roller 72 and fixing belt 10, or by depression of the peripheral surface of second pressure roller 73.

As described, the fixing device is suitable for a fixing device of an electrophotographic image forming apparatus, and achieves remarkable effects when it is employed in a high speed image forming apparatus.

[Image Forming Apparatus]

The image forming apparatus according to the present embodiment includes the fixing device that heats and presses an unfixed toner image formed by an electrophotographic process on a recording medium to fix the unfixed toner image to the recording medium. The image forming apparatus may have a configuration similar to that of a publicly known image forming apparatus except that the above-mentioned fixing device is employed as its fixing device. In the following, an example of the image forming apparatus according to the present embodiment is described with reference to FIG. 3.

Figure 3:
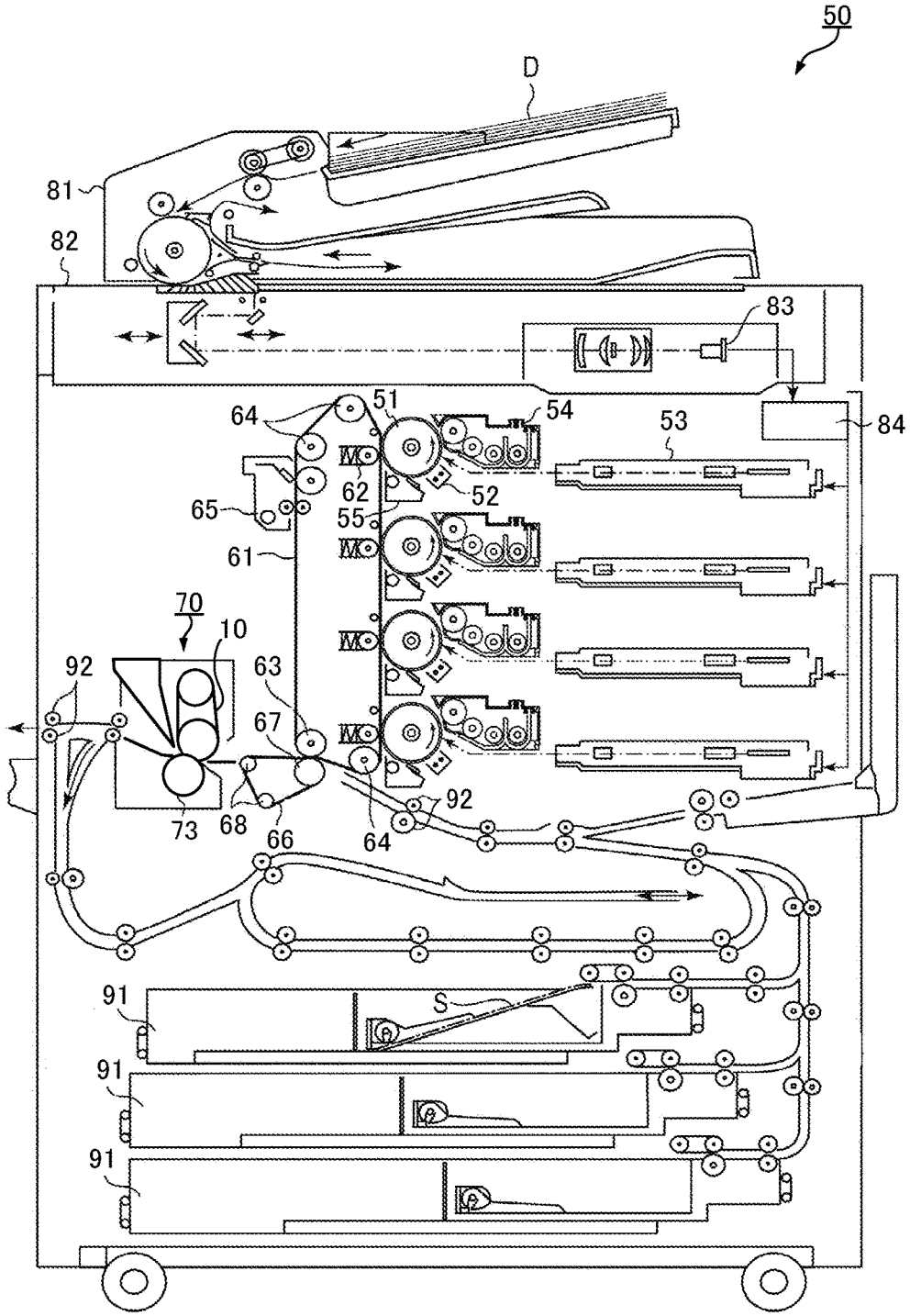
FIG. 3 schematically illustrates an example of an image forming apparatus according to the embodiment of the present invention.

As illustrated in FIG. 3, image forming apparatus 50 includes an image forming section, an intermediate transfer section, fixing device 70, an image reading section and a recording medium conveyance section.

The image forming section includes four image forming units for respective colors of yellow, magenta, cyan and black, for example. As illustrated in FIG. 3, the image forming unit includes photoconductor drum 51, charging device 52 for charging photoconductor drum 51, exposing device 53 for irradiating charged photoconductor drum 51 with light to form an electrostatic latent image, developing device 54 for supplying toner to photoconductor drum 51 on which an electrostatic latent image is formed to form a toner image according to the electrostatic latent image, and cleaning apparatus 55 for removing remaining toner of photoconductor drum 51.

Photoconductor drum 51 is an organic photoconductor of a negative charge type having photo conductivity for example. Charging device 52 is a corona charger for example. Charging device 52 may alternatively be a contact charging device that brings a charging member such as a charging roller, a charging brush and a charging blade into contact with photoconductor drum 51 for charging. Exposing device 53 is composed of a semiconductor laser. Developing device 54 is a publicly known developing device in an electrophotographic image forming apparatus, for example. The term "toner image" refers to a state where toner is collected into an image.

The intermediate transfer section includes a primary transfer unit and a secondary transfer unit. The primary transfer unit includes intermediate transfer belt 61, primary transfer roller 62, backup roller 63, a plurality of support rollers 64 and cleaning apparatus 65. Intermediate transfer belt 61 is an endless belt. Intermediate transfer belt 61 is installed in a stretched state in a loop form on backup roller 63 and support roller 64. When at least one of backup roller 63 and support roller 64 is driven into rotation, intermediate transfer belt 61 travels on an endless path in one direction at a constant speed.

The secondary transfer unit includes secondary transfer belt 66, secondary transfer roller 67 and a plurality of support rollers 68. Secondary transfer belt 66 is also an endless belt. Secondary transfer belt 66 is installed in a stretched state in a loop form on secondary transfer roller 67 and support roller 68.

Fixing device 70 is fixing device 70 illustrated in FIG. 2 for example. Sheet S corresponds to a recording medium.

The image reading section includes sheet feeding device 81, scanner 82, CCD sensor 83 and image processing section 84. The recording medium conveyance section includes three sheet feed tray units 91 and a plurality of registration roller pairs 92. Sheets S (standard sheets and special sheets) discriminated based on their basis weight, size and the like are stored in respective sheet feed tray units 91 in advance on a predetermined type basis. Registration roller pairs 92 are disposed so as to form a desired conveyance path.

[Image Formation Method]

The image formation method according to the present embodiment includes a step of fixing an unfixed toner image formed by an electrophotographic process on a recording medium to the recording medium by heating and pressing the unfixed toner image with use of the fixing device. The image formation method can be carried out by image forming apparatus 50. As an example of the image formation method, image formation using image forming apparatus 50 is described below.

Scanner 82 optically scans and reads document D sent from sheet feeding device 81 on the contact glass. Reflection light from document D is read out by CCD sensor 83 and used as input image data. Image processing section 84 performs predetermined image processing on the input image data, and the data is sent to exposing device 53.

Photoconductor drum 51 rotates at a constant circumferential velocity corresponding to a printing rate of 60 sheets per minute or greater for recording mediums of A4 size.

Charging device 52 evenly and negatively charges the surface of photoconductor drum 51. Exposing device 53 irradiates photoconductor drum 51 with laser light corresponding to input image data of each color component. Thus, an electrostatic latent image is formed on the surface of photoconductor drum 51. Developing device 54 attaches toner to the surface of photoconductor drum 51 to visualize the electrostatic latent image. Thus, a toner image according to the electrostatic latent image is formed on the surface of photoconductor drum 51. The toner image on the surface of photoconductor drum 51 is transferred to intermediate transfer belt 61. The transfer residual toner of photoconductor drum 51 is removed by cleaning apparatus 55. Color toner images formed by respective photoconductor drums 51 are sequentially transferred to intermediate transfer belt 61 in an overlapping manner.

Secondary transfer roller 67 presses secondary transfer belt 66 toward backup roller 63, and brings secondary transfer belt 66 into pressure contact with intermediate transfer belt 61. Thus a secondary transfer nip portion is formed. Meanwhile, sheet S is conveyed from sheet feed tray units 91 to the secondary transfer nip portion through registration roller pairs 92. Registration roller pairs 92 correct skew of sheet S, and adjust the conveyance timing.

When sheet S is conveyed to the secondary transfer nip, a transfer voltage is applied to secondary transfer roller 67, and the toner image on intermediate transfer belt 61 is transferred to sheet S. Sheet S on which the toner image has been transferred is conveyed to fixing device 70 by secondary transfer belt 66. The transfer residual toner on intermediate transfer belt 61 is removed by cleaning apparatus 65.

In fixing device 70, fixing belt 10 rotates at a printing rate of 60 sheets per minute or greater for recording mediums of A4 size, and, as described above, second pressure roller 74 forms the fixing nip portion together with fixing belt 10 at the time of conveying sheet S. Sheet S is heated and pressed at the fixing nip portion and is guided so as to be ejected to the outside of image forming apparatus 50 with the resilience of fixing belt 10 as described above. In the above-mentioned manner, a toner image is formed on sheet S, and the sheet S is ejected out of the apparatus.

As is obvious from the above descriptions, the fixing belt is an endless fixing belt including: a base layer including a heat-resistant resin; an elastic layer including an elastic material; and a releasing layer, the base layer, the elastic layer and the releasing layer being stacked on one another in this order, the fixing belt being to be rotatably supported by two or more rollers including a heating roller, in which the elastic material has a loss tangent tan δ of 0.1 or smaller, the loss tangent tan δ being a ratio of a loss modulus relative to a storage modulus at 20 Hz. Thus, the fixing belt is advantageous in fixation performance of the toner image as well as separativeness of the recording medium.

In addition, the configuration in which the tan δ is greater than 0.01 is advantageous from the viewpoint of achieving favorable dynamic viscoelasticity for achieving both the fixation performance and the separativeness.

In addition, the configuration in which the heat-resistant resin is a polyimide, the elastic material is a silicone rubber, and the material of the releasing layer is perfluoro-alkoxy fluororesin is advantageous from the viewpoint of readily producing a fixing belt having a favorable dynamic viscoelasticity.

In addition, the fixing device includes the fixing belt, two or more rollers that include the heating roller for heating the fixing belt and rotatably support the fixing belt, and the pressure roller that is disposed in such a manner that it is to be relatively biased against one of the rollers with the fixing belt therebetween. Thus, it is possible to achieve fixation which is favorable from the viewpoint of fixation of the toner image as well as separation of the recording medium.

In addition, from the view point of application to fixation of high speed image formation, it is advantageous that the tensile force of the fixing belt rotatably supported by the rollers is 45 N or smaller, and, the roller diameter of the roller of the rollers disposed to be biased by the pressure roller is 45 mm or greater, more preferably 60 mm or greater. In addition, the separation angle of the recording medium subjected to fixation is preferably 67 to 85 degrees, more preferably 73 to 77 degrees from the view point of application to fixation of high speed image formation.

In addition, the image forming apparatus includes the fixing device according to the present embodiment that fixes to the recording medium an unfixed toner image formed by an electrophotographic process on the recording medium through heating and pressing, and the image formation method includes a step of fixing an unfixed toner image formed by electrophotographic process on a recording medium to the recording medium by heating and pressing the unfixed toner image with use of the fixing device according to the present embodiment, and therefore, the image forming apparatus and the image formation method both can achieve fixation in which fixation of the toner image and separation of the recording medium are favorable.

In addition, even in the case of high speed image formation in which the fixation rate of the fixing device is 60 sheets per minute or higher for the recording medium of A4 size, the effects of the fixing belt and the fixing device of the present embodiment can be achieved, and further speedup and power saving in such high speed image formation are facilitated.

As is obvious from the above descriptions, according to the embodiment, it is possible to provide a fixing belt having favorable fixation performance of the toner image and separativeness of the recording medium. With the fixing belt, it is possible to achieve fixation in which both the fixation performance of the toner image and the separativeness of the recording medium are favorable in an electrophotographic image forming apparatus and an image formation method.

EXAMPLES

The present invention is further specifically described with examples and comparative examples. In the following description, each operation is performed at a room temperature (20° C.) unless otherwise noted. It is to be noted that the present invention is not limited to the examples and so forth.

Example 1

A cylindrical mandrel made of stainless-steel having an outer diameter of 60 mm is closely attached on the inner side of a belt base material made of a heat curable polyimide resin having an internal diameter of 99 mm, a length of 360 mm, and a thickness of 70 μm. Next, a cylindrical metal mold holding a PFA tube having a thickness of 30 μm on the inner peripheral surface thereof is provided on the outer side of the belt base material. Thus, the mandrel and the cylindrical metal mold are coaxially held, while forming a cavity therebetween. Next, silicone rubber material A is injected to the cavity and subjected to heat-curing, and an elastic layer of silicone rubber A having a thickness of 200 μm is produced. In this manner, fixing belt 1 in which the belt base material, the elastic layer of silicone rubber A and the releasing layer made of PFA are stacked on top of one another in this order is produced.

It is to be noted that silicone rubber material A is a composition obtained by mixing 100 parts by weight of dimethyl polysiloxane having a vinyl group on a side chain and 20 parts by weight of silica. In addition, silicone rubber A has a rubber hardness of 30, a tensile strength of 1.9 MPa, an extension of 380%, a thermal conductivity of 0.3 W/m·K, and a tan δ of 0.048.

The rubber hardness of silicone rubber A is measured with durometer A with use of a rubber sheet for measurement having a thickness of 2.0 mm on the basis of JIS K6301. The rubber sheet is produced under a manufacturing condition same as that of the elastic layer.

The tensile strength of silicone rubber A is measured with TENSIRON Universal Material Testing Instrument (A&D Company, LTD.) with use of the rubber sheet. The extension of silicone rubber A is measured with TENSIRON Universal Material Testing Instrument (available from A&D Company, LTD.) with use of the rubber sheet. The thermal conductivity of silicone rubber A is measured with QTM-Quick Thermal Conductivity Meter (KYOTO ELECTRONICS MANUFACTURING CO., LTD.) with use of the rubber sheet.

Figure 4:
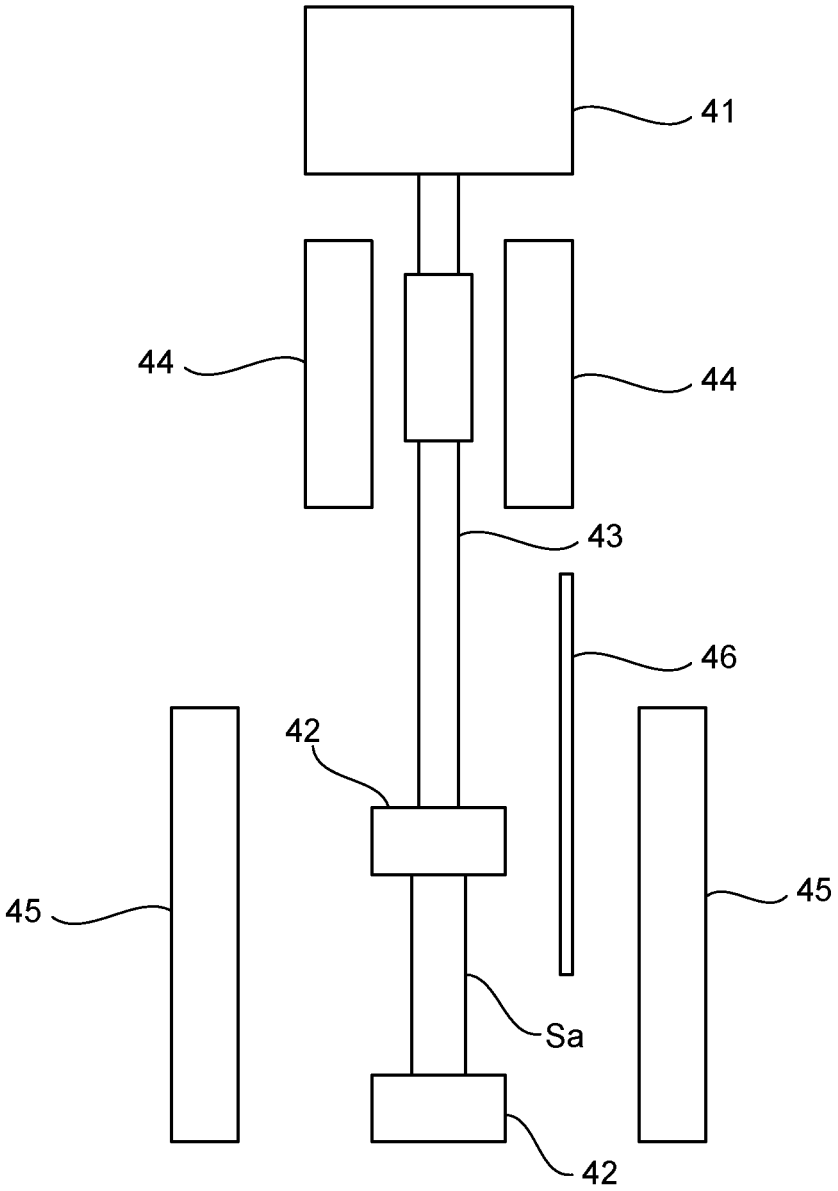
FIG. 4 schematically illustrates a configuration of a dynamic viscoelasticity measuring device that is used for measurement of tan δ of an elastic material in the present invention.

The tan δ of silicone rubber A is measured with a dynamic viscoelasticity measuring device illustrated in FIG. 4 with use of the rubber sheet. As illustrated in FIG. 4, the dynamic viscoelasticity measuring device includes load generating part 41, holders 42, 42 for holding both ends of a sample (rubber sheet) Sa, probe 43 for connecting load generating part 41 and holder 42, displacement detection section 44 for detecting the amount of displacement of probe 43, heater 45 for adjusting the ambient temperature of sample Sa held by holders 42, 42, and thermometer 46 for detecting the ambient temperature.

The tan δ of silicone rubber A is obtained from a result of detection in which: the both ends of the rubber sheet having a size of 10 mm×40 mm in the longitudinal direction are pinched by holders 42, 42; a sine wave force having an amplitude of 1% of the length in the longitudinal direction of the rubber sheet is generated by load generating part 41 at 20 Hz in a room temperature atmosphere; and the amount of displacement in this state is detected with displacement detection section 44.

[Evaluation]

Fixing belt 1 is installed as the fixing belt illustrated in FIGS. 1A and 1B of an electrophotographic image forming apparatus including a biaxial belt fixing device. The roller that forms the fixing nip portion, and rotatably supports fixing belt 1 has a roller diameter of 60 mm, and the separation angle at a printing rate of 60 A4-plain sheets per minute in the fixing device is 73 degrees. In addition, "digital toner HD+" available from Konica Minolta Inc. is used as toner.

(1) Fixation Performance

A solid black belt-shaped image having a width of 5 cm is formed on an A4-size plain sheet in a direction perpendicular to the conveyance direction at a printing rate of 60 sheets per minute, and the image thus obtained is visually observed to determine the fixation performance on the basis of the following criteria.

A: Solid image does not have a defect due to fixation problems

B: Solid image has a defect due to fixation problems (2) Separativeness

The surface temperature of fixing belt 1 is set to 180° C., and the A4-size plain sheet on which the above-mentioned solid image has been formed is conveyed at a speed of 60 sheets per minute in the vertical direction. The separativeness on the image formation side between fixing belt 1 and the plain sheet at this time is determined on the basis of the following criteria.

A: The plain sheet is separated from the fixing belt by the airflow without being curled B: The plain sheet is separated from the fixing belt by the airflow but is slightly curled C: The plain sheet is stuck to the fixing belt and cannot be separated

Examples 2 and 3 and Comparative Examples 1 to 3

Fixing belt 2 having an elastic layer made of silicone rubber B, fixing belt 3 having an elastic layer made of silicone rubber C, fixing belt C1 having an elastic layer made of silicone rubber D, fixing belt C2 having an elastic layer made of silicone rubber E, and fixing belt C3 having an elastic layer made of silicone rubber F are produced in a manner similar to that of silicone rubber A except that the type of the dimethyl polysiloxane having a vinyl group on a side chain, the mixing ratio, and the amount of the additive and the like are adjusted. In addition, in a manner similar to that of silicone rubber A, the physical properties of silicone rubbers B to F are measured. Further, the fixation performance and the separativeness are determined in a manner similar to that of Example 1 except that fixing belts 2, 3, and C1 to C3 are used instead of fixing belt 1.

The physical properties of silicone rubbers A to F and the evaluations of fixing belts 1 to 3, and C1 to C3 are shown in table 1.

As is obvious from Table 1, each of fixing belts 1 to 3 shows sufficient fixation performance and sufficient separativeness in a high speed image forming apparatus using a biaxial belt type fixing device. One possible reason for this is that the configuration in which tan δ is sufficiently low and the elasticity is sufficiently high relative to the viscosity in the elastic layer of the fixing belt provides a sufficient resilience to the fixing belt following the recording medium at the time of fixation, and achieves separation and followability with respect to the recording medium in a high-speed machine.

In contrast, each of fixing belts C1 to C3 shows sufficient fixation performance but does not show sufficient separativeness in a high speed image forming apparatus using a biaxial belt fixing device. One possible reason for this is that tan δ is high and the elasticity relative to the viscosity is insufficient in the elastic layer of the fixing belt, and consequently the sufficient resilience for providing separativeness is not generated in the fixing belt following the recording medium at the time of fixation.

As is obvious from the above descriptions, a fixing belt including: a base layer made of a heat-resistant resin; an elastic layer made of an elastic material; and a releasing layer, the base layer, the elastic layer and the releasing layer being stacked on one another in this order, the fixing belt having an endless form and being rotatably supported by two or more rollers including a heating roller, in which the elastic material has a loss tangent tan δ of 0.1 or smaller, the loss tangent tan δ being a ratio of a loss modulus relative to a storage modulus at 20 Hz achieves sufficient fixation performance and separativeness in the high-speed machine.

In addition, from the above descriptions, the configuration in which the tan δ is 0.050 or smaller is advantageous from the viewpoint of increasing the separativeness.

INDUSTRIAL APPLICABILITY

According to the present invention, in an image formation method using an electrophotographic process in a high-speed machine having a biaxial belt type fixing device, favorable fixation can be achieved and paper jam can be prevented from occurring. Therefore, according to the present invention, speedup, enhancement in performance and power saving in an electrophotographic image forming apparatus can be expected, and popularization of the image forming apparatuses can be expected.

TABLE 1

| | | Elastic layer | | | | | | Evaluation | |
|---|---|---|---|---|---|---|---|---|---|
| | Fixing belt | Silicone rubber | Rubber hardness (—) | Tensile strength (MPa) | Extension (%) | Thermal conductivity (W/m · K) | Tan δ (—) | Fixation performance | Separativeness |
| Example 1 | 1 | A | 30 | 1.9 | 380 | 0.3 | 0.048 | A | A |
| Example 2 | 2 | B | 30 | 1.1 | 160 | 0.3 | 0.071 | A | B |
| Example 3 | 3 | C | 44 | 2.9 | 130 | 0.5 | 0.089 | A | B |
| Comparative example 1 | C1 | D | 30 | 0.8 | 200 | 0.3 | 0.125 | A | C |
| Comparative example 2 | C2 | E | 16 | 0.9 | 300 | 0.5 | 0.128 | A | C |
| Comparative example 3 | C3 | F | 30 | 1.5 | 500 | 0.7 | 0.170 | A | C |

What is claimed is:

1. A fixing belt comprising:

a base layer comprising a heat-resistant resin;

an elastic layer comprising an elastic material; and a releasing layer, the base layer, the elastic layer and the releasing layer being sequentially stacked on one another, the fixing belt having an endless form and being configured to be rotatably supported by two or more rollers including a heating roller, wherein the elastic material includes a thermal conductive filler, the thermal conductive filler being silica, and the elastic material has a loss tangent tan δ of 0.1 or smaller, the loss tangent tan δ being a ratio of a loss modulus relative to a storage modulus at a frequency of 20 Hz and a temperature of 20° C.

2. The fixing belt according to claim 1, wherein the tan δ is greater than 0.01.

3. The fixing belt according to claim 1, wherein:

the heat-resistant resin is polyimide;

the elastic material is a silicone rubber; and the releasing layer comprises a perfluoro-alkoxy fluororesin.

4. A fixing device comprising:

the fixing belt according to claim 1 having an endless form;

two or more rollers rotatably supporting the fixing belt, the two or more rollers including a heating roller for applying heat to the fixing belt; and a pressure roller disposed to be relatively biased against one of the rollers with the fixing belt therebetween.

5. The fixing device according to claim 4, wherein the fixing belt rotatably supported by the rollers has a tensile force of 45 N or smaller.

6. The fixing device according to claim 4, wherein, among the rollers, the roller disposed to be biased by the pressure roller has a roller diameter of 45 mm or greater.

7. The fixing device according to claim 4, wherein a separation angle of a recording medium subjected to fixation is 67 to 85 degrees.

8. An image forming apparatus comprising the fixing device according to claim 4 configured to heat and press an unfixed toner image formed by an electrophotographic process on a recording medium to fix the unfixed toner image to the recording medium.

9. An image formation method comprising fixing an unfixed toner image formed by an electrophotographic process on a recording medium to the recording medium by heating and pressing the unfixed toner image by the fixing device according to claim 4.

10. The image formation method according to claim 9, wherein a fixation rate of the fixing device is 60 sheets per minute or higher for recording mediums of A4 size.

11. The fixing belt according to claim 1, wherein a thickness of the releasing layer is 5 to 40 μm.

12. The fixing belt according to claim 11, wherein a thickness of the elastic layer is 5 to 300 μm.

13. The fixing belt according to claim 1, wherein a content of the heat-resistant resin in the base layer is 40 to 100 vol %.

14. The fixing belt according to claim 1, wherein the loss tangent δ is 0.05 or smaller.

* * * * *